US011087922B2

(12) United States Patent
Ito et al.

(10) Patent No.: US 11,087,922 B2
(45) Date of Patent: Aug. 10, 2021

(54) PRODUCTION METHOD OF RARE EARTH MAGNET

(71) Applicant: TOYOTA JIDOSHA KABUSHIKI KAISHA, Toyota (JP)

(72) Inventors: Masaaki Ito, Sunto-gun (JP); Noritsugu Sakuma, Mishima (JP); Masao Yano, Toyota (JP); Hidefumi Kishimoto, Susono (JP); Tetsuya Shoji, Susono (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 734 days.

(21) Appl. No.: 15/953,183

(22) Filed: Apr. 13, 2018

(65) Prior Publication Data

US 2018/0308633 A1 Oct. 25, 2018

(30) Foreign Application Priority Data

Apr. 19, 2017 (JP) ..... JP2017-083094
Jan. 30, 2018 (JP) ..... JP2018-013804

(51) Int. Cl.
*H01F 41/02* (2006.01)
*H01F 1/057* (2006.01)
(Continued)

(52) U.S. Cl.
CPC ..... *H01F 41/0293* (2013.01); *C22C 38/005* (2013.01); *C22C 38/06* (2013.01);
(Continued)

(58) Field of Classification Search
None
See application file for complete search history.

(56) References Cited

U.S. PATENT DOCUMENTS

2016/0141083 A1* 5/2016 Ito ..... H01F 1/0572 252/62.55
2016/0240293 A1* 8/2016 Ohsawa ..... H01F 1/0577
2018/0090249 A1* 3/2018 Ohashi ..... H01F 1/0577

FOREIGN PATENT DOCUMENTS

CN 103093912 A 5/2013
CN 103123839 A 5/2013
(Continued)

*Primary Examiner* — Anthony J Zimmer
*Assistant Examiner* — Michael J Kachmarik
(74) *Attorney, Agent, or Firm* — Oliff PLC

(57) ABSTRACT

A method for producing a rare earth magnet, including preparing a melt of a first alloy having a composition represented by $(R^1{}_vR^2{}_wR^3{}_x)_yT_zB_sM^1{}_t$ (wherein $R^1$ is a light rare earth element, $R^2$ is an intermediate rare earth element, $R^3$ is a heavy rare earth element, T is an iron group element, and $M^1$ is an impurity element, etc.), cooling the melt of the first alloy at a rate of from $10^0$ to $10^2$ K/sec to obtain a first alloy ingot, pulverizing the first alloy ingot to obtain a first alloy powder having a particle diameter of 1 to 20 μm, preparing a melt of a second alloy having a composition represented by $(R^4{}_pR^5{}_q)_{100-u}M^2{}_u$ (wherein $R^4$ is a light rare earth element, $R^5$ is an intermediate or heavy rare earth element, $M^2$ is an alloy element, etc.), and putting the first alloy powder into contact with the melt of the second alloy.

14 Claims, 7 Drawing Sheets

(51) Int. Cl.

| | |
|---|---|
| ***C22C 38/16*** | (2006.01) |
| ***C22C 38/06*** | (2006.01) |
| ***B22F 1/00*** | (2006.01) |
| ***B22F 9/04*** | (2006.01) |
| ***C22C 1/04*** | (2006.01) |
| ***C22C 38/00*** | (2006.01) |

(52) U.S. Cl.

CPC ..... *C22C 38/16* (2013.01); *H01F 1/0576* (2013.01); *H01F 1/0577* (2013.01); *H01F 41/0266* (2013.01); *B22F 1/0011* (2013.01); *B22F 9/04* (2013.01); *B22F 2202/05* (2013.01); *B22F 2301/355* (2013.01); *B22F 2304/10* (2013.01); *B22F 2998/10* (2013.01); *B22F 2999/00* (2013.01); *C22C 1/0475* (2013.01)

(56) References Cited

FOREIGN PATENT DOCUMENTS

| | | | |
|---|---|---|---|
| CN | 104505206 | A | 4/2015 |
| JP | H11-315357 | A | 11/1999 |
| JP | 2015-057820 | A | 3/2015 |
| JP | 2016-111136 | A | 6/2016 |
| JP | 2016-115774 | A | 6/2016 |
| WO | 2014/196605 | A1 | 12/2014 |

* cited by examiner

PRODUCTION METHOD OF RARE EARTH MAGNET

FIELD

The present disclosure relates to a production method of an R-T-B-based rare earth magnet (R is a rare earth element, T is one or more members selected from Fe, Ni and Co, and B is boron) capable of enhancing the coercive force while suppressing reduction of magnetization. More specifically, the present disclosure relates to a production method of an R-T-B-based rare earth magnet in which even when the particle diameter of the main phase having a crystal structure represented by $R_2T_{14}B$ is large, the coercive force can be enhanced while suppressing reduction of magnetization.

BACKGROUND

An R-T-B-based rear earth magnet is a high-performance magnet having excellent magnetic properties and is therefore used for a motor constituting a hard disk, MRI (magnetic resonance imaging) device, etc. and in addition, used for a driving motor of a hybrid vehicle, an electric vehicle, etc.

The R-T-B-based rare earth magnet comprises a main phase having a crystal structure represented by $R_2T_{14}B$ and an R-rich grain boundary phase present around the main phase. The R-T-B-based rare earth magnet includes a magnet in which the particle diameter of the main phase is from 1 to 20 μm, and a magnet in which the particle diameter of the main phase is from 1 to 900 nm.

Of performance properties of the R-T-B-based rare earth magnet, magnetization and coercive force are representative. In the rare earth magnet having a main phase and an R-rich grain boundary phase present around the main phase, when the magnetization reversal is transmitted across a plurality of main phases, the coercive force decreases.

Conventionally, efforts have been made to obtain a rare earth magnet having enhanced coercive force by using, as a precursor, a rare earth magnet having a main phase and an R-rich grin boundary phase present around the main phase, and causing a penetrating material to infiltrate inside the precursor.

In addition, as to the rare earth element essential for the R-T-B-based rare earth magnet, there is a concern about skyrocketing cost, and utilization of a light rare earth element (Ce, La, and Y) that is inexpensive among rare earth elements is promoted.

For example, Patent Document 1 discloses an R-T-B-based rare earth magnet impregnated with a penetrating material. The R-T-B-based rare earth magnet disclosed in Patent Document 1 contains Ce as a light rare earth element, and the main phase thereof has a core part and a shell part present around the core part.

Generally, in an R-T-B-based rare earth magnet having a penetrating material infiltrated thereinto, when penetration by a non-magnetic penetrating material is effected, the coercive force is enhanced, but magnetization is reduced. In the case where the R-T-B-based rare earth magnet contains a light rare earth element, since magnetization of a light rare earth element is originally low, the magnetization undergoes serious reduction due to a penetrating material.

However, in the R-T-B-based rare earth magnet disclosed in Patent Document 1, the main phase has a core part and a shell part, and a rare earth element other than a light rare earth element, which is contained in the penetrating material, penetrates into the shell part. Accordingly, the penetrating material contributes not only to enhancing the coercive forth but also to suppressing the reduction of magnetization. Consequently, in the R-T-B-based rare earth magnet disclosed in Patent Document 1, the coercive force is enhanced while suppressing reduction in the magnetization.

CITATION LIST

Patent Literature

[PTL 1] Japanese Unexamined Patent Publication No. 2016-111136

SUMMARY OF THE INVENTION

Technical Problem

The R-T-B-based rare earth magnet disclosed in Patent Document 1 is produced by using, as a precursor, a rare earth magnet having a main phase and an R-rich grain boundary phase present around the main phase, and causing a penetrating material to infiltrate inside the precursor. The precursor is produced by a liquid quenching method such as single roll method, and therefore in the precursor of the R-T-B-based rare earth magnet disclosed in Patent Document 1, the particle diameter of the main phase is from 50 to 300 nm.

In the R-T-B-based rare earth magnet disclosed in Patent Document 1, since the particle diameter of the main phase of the precursor is from 50 to 300 nm, penetration by a penetrating material is likely to provide a structure where the main phase has a core part and a shell part.

On the other hand, when the particle diameter of the main phase of the precursor is from 1 to 20 μm, a structure where the main phase has a core part and a shell part can hardly be obtained even by effecting penetration by a penetrating material. For example, in the case of using an R-T-B-based rare earth magnet produced by die mold casting, etc. as the precursor, since the particle diameter of the main phase of the precursor is from 1 to 20 μm, even when a penetrating material is caused to infiltrate into the precursor, a structure in which the main phase has a core part and a shell part can hardly be formed. Accordingly, it has been difficult to enhance the coercive force while suppressing the reduction of magnetization.

Under these circumstances, the present inventors have found a problem that a production method of an R—Fe—B-based rare earth magnet, capable of enhancing the coercive force while suppressing the reduction of magnetization even when the particle diameter of the main phase is from 1 to 20 μm, is demanded.

The present disclosure has been created to solve the problem above. An object of the present invention is to provide a production method of an R-T-B-based rare earth magnet, in which even when the particle diameter of the main phase is from 1 to 20 μm, the coercive force can be enhanced while suppressing the reduction of magnetization.

Solution to Problem

The present inventors have made many intensive studies to achieve the object above and have accomplished the production method of a rare earth magnet of the present disclosure. The gist thereof is as follows.

<1> A method for producing a rare earth magnet, including:

preparing a melt of a first alloy having a composition represented by $(R^1_vR^2_wR^3_x)_yT_zB_sM^1_t$ (wherein $R^1$ is one or more members selected from the group consisting of Sc, Ce, La, and Y, $R^2$ is one or more members selected from the group consisting of Nd, Pr, Sm, Eu, and Gd, $R^3$ is one or more members selected from the group consisting of Tb, Dy, Ho, Er, Tm, Yb, and Lu, T is one or more members selected from the group consisting of Fe, Ni, and Co, B is boron, $M^1$ represents one or more members selected from the group consisting of Ti, Ga, Zn, Si, Al, Nb, Zr, Mn, V, W, Ta, Ge, Cu, Cr, Hf, Mo, P, C, Mg, Hg, Ag, Au, O, and N, and an unavoidable impurity element, and $0.1 \le v \le 1.0$, $0 \le w \le 0.9$, $0 \le x \le 0.5$, $v+w+x=1.0$, $12 \le y \le 20$, $5 \le s \le 20$, and $0 \le t \le 3$, and $z=100-y-s-t$), cooling the melt of the first alloy at a rate of $10^0$~$10^2$ K/sec to obtain a first alloy ingot, pulverizing the first alloy ingot to obtain a first alloy powder having a particle diameter of 1 to 20 μm, preparing a melt of a second alloy having a composition represented by $(R^4_pR^5q)_{100-u}M^2u$ (wherein $R^4$ is one or more members selected from the group consisting of Sc, Ce, La, and Y, $R^5$ is one or more members selected from the group consisting of Nd, Pr, Sm, Eu, Gd, Tb, Dy, Ho, Er, Tm, Yb, and Lu, $M^2$ represents one or more alloy elements for decreasing the melting point of $(R^4_pR^5_q)_{100-u}M^2_u$ to be lower than the melting points of $R^4$ and $R^5$ by alloying $R^4$ and $R^5$ with $M^2$, and an unavoidable element, $0 \le p \le 0.2$, $0.8 \le q \le 1.0$, $p+q=1.0$, and $10 \le u \le 50$), and putting the first alloy powder into contact with the melt of the second alloy.

<2> The method according to item <1>, wherein v is $0.3 \le v \le 1.0$.

<3> The method according to item <1> or <2>, wherein v is $0.5 \le v \le 1.0$.

<4> The method according to any one of items <1> to <3>, further including storing hydrogen in the first alloy ingot.

<5> The method according to any one of items <1> to <4>, including:

cooling the melt of the second alloy to obtain a second alloy ingot, pulverizing the second alloy ingot to obtain a second alloy powder, mixing the first alloy powder and the second alloy powder to obtain a mixed powder, compressing the mixed powder to obtain a compact, and sintering the compact to obtain a sintered body, wherein the first alloy powder is put into contact with a melt of the second alloy powder during the sintering.

<6> The method according to item <5>, compressing the mixed powder in a magnetic field to obtain a compact.

<7> The method according to item <5> or <6>, mixing the first alloy ingot and the second alloy ingot while pulverizing the ingots at the same time to obtain the mixed powder.

<8> The method according to any one of items <5> to <7>, further including storing hydrogen in the second alloy ingot.

<9> The method according to any one of items <5> to <8>, mixing the first alloy powder and the second alloy powder at a temperature of room temperature or more and less than the melting point of the second alloy powder.

<10> The method according to any one of items <5> to <9>, mixing the first alloy powder and the second alloy powder at a temperature of the melting point of the second alloy powder or more and 800° C. or less.

<11> The method according to any one of items <5> to <10>, further comprising heat-treating the sintered body at a temperature of the melting point of the second alloy powder or more and 1,000° C. or less.

<12> The method according to any one of items <5> to <11>, including further diffusing and infiltrating a third alloy into the sintered body, wherein the third alloy has a composition represented by $(R^4_pR^5_q)_{100-u}M^2_u$ (wherein $R^4$ is one or more members selected from the group consisting of Sc, Ce, La, and Y, $R^5$ is one or more members selected from the group consisting of Nd, Pr, Sm, Eu, Gd, Tb, Dy, Ho, Er, Tm, Yb, and Lu, $M^2$ represents one or more alloy elements for decreasing the melting point of $(R^4_pR^5_q)_{100-u}M^2_u$ to be lower than the melting points of $R^4$ and $R^5$ by alloying $R^4$ and $R^5$ with $M^2$, and an unavoidable element, $0 \le p \le 0.2$, $0.8 \le q \le 1.0$, $p+q=1.0$, and $10 \le u \le 50$).

Advantageous Effects of Invention

According to the production method of a rare earth magnet of the present disclosure, even when the particle diameter of the main phase is from 1 to 20 μm, a main phase having a core/shell structure is obtained by forming one main phase as one particle and putting a melt having the same composition as an infiltrating material into direct contact with the main phase without intervention of a grain boundary phase. As a result, according to the present disclosure, a production method of a rare earth magnet, capable of enhancing the coercive force while suppressing the reduction of magnetization, can be provided.

DESCRIPTION OF EMBODIMENTS

Figure 1:
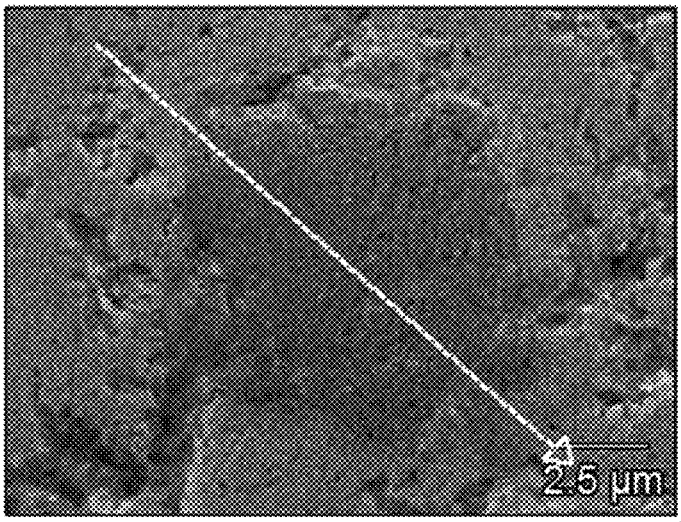
FIG. 1 is a diagram illustrating a scanning transmission electron microscope image of the sample of Example 1.

The embodiments of the production method of a rare earth magnet according to the present disclosure are described in detail below. The embodiments described below should not be construed to limit the production method of a rare earth magnet according to the present disclosure.

The R-T-B-based rare earth magnet comprises a main phase and an R-rich grain boundary phase present around the main phase. In the case of using such a rare earth magnet as a precursor (hereinafter, referred to as "rare earth magnet precursor") and causing an infiltrating material to infiltrate inside the rare earth magnet precursor, the infiltrating material infiltrates through a grain boundary phase of the rare earth magnet. Then, when the rare earth element in the rare earth magnet precursor and the rare earth element in the infiltrating material are different, the infiltrating material infiltrates also into the main phase of the rare earth magnet precursor, and a structure having a core part and a shell part (hereinafter, referred to as "core/shell structure") is formed in the main phase.

In the case where the rare earth magnet precursor contains a light rare earth element and the infiltrating material contains a rare earth element other than a light rare earth element, the rare earth element in the infiltrating material other than a light rare earth element penetrates into the main phase to form a core/shell structure in the main phase. Consequently, the penetrating material contributes not only to enhancing the coercive force but also to suppressing the reduction of magnetization.

It is known that when the particle diameter of the main phase of the rare earth magnet precursor is from 1 to 900 nm, the main phase after infiltration is likely to have a core/shell structure. Although not bound by theory, it is believed that the reason therefor is as follows.

When the particle diameter of the main phase is from 1 to 900 nm, the main phase is a so-called nano-crystal grain, and therefore its surface is activated. Accordingly, when an infiltrating material infiltrates into the grain boundary phase and the main phase and the grain boundary phase contain different kinds of rare earth elements, different rare earth elements are mutually diffused at the interface between the main phase and the grain boundary phase.

On the other hand, when the particle diameter of the main phase of the rare earth magnet precursor is from 1 to 20 μm, the surface area of the main phase is small, making it difficult to activate the surface, and different rare earth elements are less likely to be mutually diffused at the interface between the main phase and the grain boundary phase. As a result, even when an infiltrating material infiltrates into the grain boundary, it is unlikely that the infiltrating material infiltrates into the main phase and a core/shell structure is formed in the main phase.

The present inventors have therefore attempted to form one main phase (crystal grain) as one particle and bring a melt having the same composition as the infiltrating material into direct contact with the main phase without intervention of a grain boundary phase. Then, it has been found that a main phase having a core/shell structure is obtained.

From these, the present inventors have discovered that even when the particle diameter of the main phase is from 1 to 20 μm, a main phase having a core/shell structure is obtained by forming one main phase as one particle and brining a melt having the same composition as the penetrating material into direct contact with the main phase without intervention of a grain boundary phase.

The configuration requirements of the production method of a rare earth magnet according to the present disclosure based on the discovery above are described below.

<<Production Method of Rare Earth Magnet of the Present Disclosure>>

The production method of a rare earth magnet of the present disclosure includes preparing a melt of a first alloy, cooling the molten first alloy to obtain a first alloy ingot, pulverizing the first alloy ingot to obtain a first alloy powder, preparing a melt of a second alloy, and putting the first alloy powder into contact with the melt of the second alloy. Each step is described below.

<Step of Preparing Melt of First Alloy>

Firstly, a melt of a first alloy is prepared. The composition of the first alloy is represented by $(R^1_vR^2_wR^3_x)_yT_zB_sM^1_t$.

$R^1$ is one or more members selected from the group consisting of Sc, Ce, La, and Y. $R^1$ is sometimes referred to as a light rare earth element.

$R^2$ is one or more members selected from the group consisting of Nd, Pr, Sm, Eu, and Gd. $R^2$ is sometimes referred to as an intermediate rare earth element.

$R^3$ is one or more members selected from the group consisting of Tb, Dy, Ho, Er, Tm, Yb, and Lu. $R^3$ is sometimes referred to as a heavy rare earth element.

T is one or more members selected from the group consisting of Fe, Ni, and Co. B is boron $M^1$ represents one or more members selected from the group consisting of Ti, Ga, Zn, Si, Al, Nb, Zr, Mn, V, W, Ta, Ge, Cu, Cr, Hf, Mo, P, C, Mg, Hg, Ag, Au, O, and N, and an unavoidable impurity element. $M^1$ represents an element added in a small amount within the range not compromising the magnetic properties of a rare earth magnet obtained by the production method of the present disclosure, and an unavoidable impurity. The unavoidable impurity indicates an impurity that is unavoidably contained or causes a significant rise in the production cost for avoiding its inclusion, such as impurity contained in a raw material.

y is the total content of $R^1$, $R^2$ and $R^3$, z is the content of T, s is the content of B, t is the total content of $M^1$, and each of the values y, z, s and t is at %. Since z is expressed by $z=100-y-s-t$, the content of T is the remainder after removing $R^1$, $R^2$, $R^3$, B and $M^1$. When $12 \le y \le 20$, $5 \le s \le 20$, and $0 \le t \le 3$, a proper amount of main phase represented by $(R^1,R^2,R^3)_2T_{14}B$ is present in the first alloy ingot obtained by cooling the melt of the first alloy. In addition, a proper amount of $(R^1,R^2,R^3)$-rich grain boundary phase is present around the main phase.

When t, i.e., the content of $M^1$ is 3 at % or less, the magnetic properties of a rare earth magnet obtained by the production method of the present disclosure are not compromised, and the magnetic properties may be believed to be comparable to those in the case of not containing $M^1$. The content of $M^1$ may be 2 at % or less, 1 at % or less, or 0 at %, but when absolutely no unavoidable impurity element is contained, the production cost excessively rises. For this reason, the content of $M^1$ may be 0.1 at % or more, 0.3 at % or more, or 0.5 at % or more.

T is classified into an iron group element, and Fe, Ni and Co have in common a property of exhibiting ferromagnetism at normal temperature and normal pressure. Accordingly, these may be interchanged with each other. When Co is contained, the magnetization of a rare earth magnet obtained by the production method of the present disclosure is enhanced, and the Curie point rises. This effect is exhibited at a Co content of 1 at % or more relative to the total T content. From this point of view, the content of Co is preferably 1 at % or more, more preferably 3 at % or more, still more preferably 5 at % or more, relative to the total T content. On the other hand, since Co and Ni are expensive and Fe is least expensive, in view of profitability, the content of Fe is preferably 80 at % or more, more preferably 90 at % or more, relative to the total T content, and the entirety of T may be Fe.

v, w, and x represent the proportions of $R^1$, $R^2$, and $R^3$, respectively. Since $v+w+x=1.0$, each of v, w, and x is a ratio to the overall total content of $R^1$, $R^2$ and $R^3$. As described above, the main phase of the rare earth magnet obtained by the production method of the present disclosure has a core/shell structure. By having a core/shell structure, an effect of enhancing the coercive force while suppressing the reduction of magnetization is obtained. This effect is obtained when $0.1 \leq v \leq 1.0$, $0 \leq w \leq 0.9$, and $0 \leq x \leq 0.5$. This effect is related also to the second alloy, and therefore is described in detail later.

The higher the ratio of the light rare earth element contained relative to the overall content of rare earth elements in the first alloy, the larger the effect of enhancing the coercive force while suppressing the reduction of magnetization. For this reason, $0.3 \leq v \leq 1.0$ is preferred, $0.5 \leq v \leq 1.0$ is more preferred, $0.7 \leq v \leq 1.0$ is still more preferred. From the viewpoint of increasing the ratio of the light rare earth element contained relative to the overall content of rare earth elements in the first alloy, the ratio may be $0 \leq w \leq 0.7$, $0 \leq w \leq 0.5$, $0 \leq w \leq 0.3$, or $0 \leq w \leq 0.1$. Similarly, the ratio may be $0 \leq x \leq 0.3$ or $0 \leq x \leq 0.1$ A melt of the first alloy is prepared by blending raw materials to provide the composition described above and melting the raw materials. The raw materials are not particularly limited as long as they can be blended and melted to provide the above-described composition. As the raw material, for example, a pure metal, a pure substance, an alloy, and/or a compound of each of the elements constituting the first alloy may be used. The alloy includes, for example, Fe alloy and Fe—B alloy of a rare earth element.

The melting method is not particularly limited. The melting method includes, for example, high frequency melting and arc melting. From the viewpoint that the composition of the melt can hardly be changed during melting, for example, high frequency melting is preferred. In the case where during melting, a specific component is consumed due to evaporation, etc. or a specific component forms an oxide and is discharged as slag, the raw materials are blended by taking into account the consumption or discharge.

The melting temperature (the temperature of the melt) may be, for example, 1,200° C. or more, 1,250° C. or more, or 1,300° C. or more, and may be 1,500° C. or less, 1,450° C. or less, or 1,400° C. or less.

<Step of Cooling Melt of First Alloy>

The melt of the first alloy is cooled at a rate of $10^0$ to $10^2$ K/sec to obtain a first alloy ingot. When the cooling rate is $10^2$ K/sec or less, the particle diameter of the main phase in the first alloy ingot becomes 1 μm or more. From the viewpoint of achieving a particle diameter of 1 μm or more, the cooling rate is preferably $0.8 \times 10^2$ K/sec or less, more preferably $0.6 \times 10^2$ K/sec or less, still more preferably $0.4 \times 10^2$ K/sec or less. On the other hand, when the cooling rate is $10^0$ K/sec or more, the particle diameter of the main phase in the first alloy becomes 20 μm or less. Incidentally, $10^0$ K/sec or more means 1 K/sec or more. From the viewpoint of achieving a particle diameter of 20 μm or less, the cooling rate is preferably 15 K/sec or more, more preferably 20 K/sec or more, still more preferably 25 K/sec or more. The particle diameter of the main phase may be, for example, 2 μm or more, 4 μm or more, or 8 μm or more, and may be 18 μm or less, 16 μm or less, or 14 μm or less. In the present description, the particle diameter of the main phase is an average equivalent-circle diameter of projected areas of all main phases.

As long as the cooling rate is in the range above, the method of cooling the melt of the first alloy is not limited. The cooling method includes, for example, a method of adjusting the circumferential velocity to the range of 1 to 10 m/sec by mold casting or a single roll method. Incidentally, the above-described circumferential velocity is that in the case of a copper-made single roll.

At the time of obtaining the first alloy ingot by using a copper-made single roll, the form of the first alloy ingot includes, for example, a powder, a flake, and a ribbon. When the particle diameter of the main phase is from 1 to 20 μm, the thickness of the ribbon may be, for example, 10 μm or more, 30 μm or more, or 50 μm or more, and may be 500 μm or less, 300 μm or less, or 100 μm or less. The thickness of the ribbon indicates an average thickness of the entire ribbon.

The mold used at the time of mold casting includes, for example, a book mold. The thickness of the first alloy ingot produced by book molding may be, for example, 1 mm or more, 3 mm or more, or 5 mm or more, and may be 20 mm or less, 15 mm or less, or 10 mm or less.

<Step of Pulverizing First Alloy Ingot>

The first alloy ingot is pulverized to obtain a first alloy powder having a particle diameter of 1 to 20 μm. The first alloy ingot has a plurality of main phases and a $(R^1,R^2,R^3)$-rich grain boundary phase present therearound. The main phase has a crystal structure represented by $(R^1,R^2,R^3)_2T_{14}B$. On the other hand, the grain boundary phase is amorphous or has an irregular atomic arrangement. Accordingly, the grain boundary phase is more brittle than the main phase. Consequently, when the first alloy ingot is pulverized, the grain boundary phase is cracked to cause separation into individual main phases (crystal grains).

As described above, the particle diameter of the main phase in the first alloy ingot is from 1 to 20 μm. When a first alloy powder having a particle diameter of 1 to 20 μm is obtained by pulverizing the first alloy ingot, 80% or more particles out of all particles of the first alloy powder each has one main phase (crystal grain). In the present description, this is sometimes referred to as "each individual particle of the first alloy powder has one main phase having a crystal structure represented by (R1,R2,R3)2T14B", "each individual particle of the first alloy powder has one main phase", or "one main phase is formed as one particle", etc. $R^1$ is essential. In addition, 80 vol % or more of the grain boundary phase present around the main phase is removed. The particle diameter of the first alloy powder may be, for example, 2 μm or more, 4 μm or more, or 8 μm or more, and may be 18 μm or less, 16 μm or less, or 14 μm or less. In the present description, the particle diameter of the first alloy powder is an average equivalent-circle diameter of projected areas of all particles.

As long as the ingot can be pulverized as described above, the pulverization method is not particularly limited. The pulverization method includes, for example, a method of pulverizing the first alloy ingot by using a jet mill and/or a ball mill, etc. The air stream used in the jet mill includes, for example, a nitrogen stream.

From the viewpoint of removing the grain boundary phase present around the main phase without damaging the main phase, pulverization using a jet mill is preferred.

Before pulverization using a jet mill and/or a ball mill, etc., the first alloy ingot may be roughly pulverized using, for example, a jaw crusher and/or a hammer mill.

Before pulverizing the first alloy ingot, hydrogen may be stored in the first alloy ingot. Storing hydrogen facilitates pulverization of the first alloy ingot. Furthermore, in the case of compacting and sintering the first alloy powder and second alloy powder, hydrogen released in the temperature rise process during sintering facilitates separation of a hydrocarbon-based lubricant added at the time of compacting. As a result, an impurity remaining in the sintered body, such as carbon and/or oxygen, can be decreased. The sintering is described later.

The amount of hydrogen stored may be, in terms of hydrogen pressure, 0.05 MPa or more, 0.10 MPa or more, or 0.30 MPa or more, and may be 1.00 MPa or less, 0.70 MPa or less, or 0.50 MPa or less.

The method for storing hydrogen in the first alloy ingot may be a conventional method. Examples thereof include a method of exposing the first alloy ingot to a hydrogen atmosphere. At this time, the hydrogen pressure may be, for example, 1.0 atm or more, 1.5 atm or more, or 2.0 atm or more, and may be 5.0 atm or less, 4.0 atm or less, or 3.0 atm or less. The temperature of the hydrogen atmosphere may be, for example, 10° C. or more, 20° C. or more, 50° C. or more, 100° C. or more, or 200° C. or more, and may be 500° C. or less, 400° C. or less, 350° C. or less, 300° C. or less, or 250° C. or less.

A case of storing hydrogen in the first alloy ingot is described, and it may also be possible to roughly pulverize the first alloy ingot and store hydrogen in the first alloy ingot after the rough pulverization.

<Step of Preparing Melt of Second Alloy>

A melt of a second alloy is prepared. The composition of the second alloy is represented by $(R^4_pR^5_q)_{100-u}M^2_u$.

$R^4$ is one or more members selected from the group consisting of Sc, Ce, La, and Y, and $R^5$ is one or more members selected from the group consisting of Nd, Pr, Sm, Eu, Gd, Tb, Dy, Ho, Er, Tm, Yb, and Lu.

$M^2$ represents one or more alloy elements for decreasing the melting point of $(R^4_pR^5_q)_{100-u}M^2_u$ to be lower than the melting points of $R^4$ and $R^5$ by alloying $R^4$ and $R^5$ with $M^2$, and an unavoidable element. The unavoidable impurity indicates an impurity that is unavoidably contained or causes a significant rise in the production cost for avoiding its inclusion, such as impurity contained in a raw material. From the viewpoint of achieving a larger amount of mutual diffusion of $R^4$ and $R^5$, the second alloy preferably contains $R^5$ in a larger amount than $R^4$. Mutual diffusion is described later. For this reason, $0 \le p \le 0.2$, $0.8 \le q \le 1.0$, and $p+q=1.0$. These may be $0 \le p \le 0.1$, $0.9 \le q \le 1.0$, and $p+q=1.0$, or $0 \le p \le 0.05$, $0.95 \le q \le 1.00$, and $p+q=1.00$.

u is the content of $M^2$ and is at %. When $M^2$ is a plurality of elements, the content is the total content of those elements. $R^4$ and $R^5$ are a balance of $M^2$. When $10 \le u \le 50$, the melting point of $(R^4_pR^5_q)_{100-u}M^2_u$ can be decreased to be lower than the melting points of $R^4$ and $R^5$.

The second alloy includes an Nd—Cu alloy, a Pr—Cu alloy, a Tb—Cu alloy, a Dy—Cu alloy, an La—Cu alloy, a Ce—Cu alloy, an Nd—Pr—Cu alloy, an Nd—Al alloy, a Pr—Al alloy, an Nd—Pr—Al alloy, an Nd—Co alloy, a Pr—Co alloy, an Nd—Pr—Co alloy, etc. Such an alloy may further contain one or more members selected from the group consisting of Sc, Ce, La, and Y.

A melt of the second alloy is prepared by blending raw materials to provide the composition described above and melting the raw materials. The raw materials are not particularly limited as long as they can be blended and melted to provide the above-described composition. As the raw material, for example, a pure metal, a pure substance, an alloy, or a compound of each of the elements constituting the second alloy may be used.

The melting method is not particularly limited. The melting method includes, for example, high frequency melting and arc melting. From the viewpoint that the composition of the melt can hardly be changed during melting, for example, high frequency melting is preferred. In the case where during melting, a specific component is consumed due to evaporation, etc. or a specific component forms an oxide and is discharged as slag, the raw materials are blended by taking into account the consumption or discharge.

<Step of Putting First Alloy Powder into Contact with Melt of Second Alloy>

The first alloy powder is put into contact with the melt of the second alloy. For preventing oxidation of the first alloy powder and/or the melt of the second alloy, the first alloy powder is preferably put into contact with the melt of the second alloy in a vacuum or an inert gas atmosphere. The inert gas atmosphere includes a nitrogen gas atmosphere.

The contacting method is not particularly method. The method includes, for example, a method of pouring the first alloy powder in the melt of the second alloy and stirring the melt. Alternatively, it may be possible to obtain a second alloy ingot by cooling the melt of the second alloy, hold the first alloy powder and the second alloy ingot in a container, and heat the contents in the container at a temperature not less than the melting point of the second alloy, or it may also be possible to obtain a second alloy powder by pulverizing the second alloy ingot, mix the first alloy powder and the second alloy powder, hold the mixture in a container, and heat the contents in the container at a temperature not less than the melting point of the second alloy.

The melting point of the second alloy is lower than the melting point of the first alloy powder. In the case of setting the temperature of the melt during contact to be not less than the melting point of the second alloy and less than the melting point of the first alloy, the first alloy powder is not melted even when the first alloy powder in the melt of the second alloy is put into contact with the melt of the second alloy.

The temperature of the melt during contact may be, for example, 450° C. or more, 475° C. or more, 500° C. or more, 525° C. or more, or 550° C. or more, and may be 800° C. or less, 750° C. or less, 700° C. or less, 675° C. or less, or 650° C. or less.

The contact time may be appropriately determined according to the mass, etc. of the first alloy powder. The contact time may be, for example, 5 minutes or more, 10 minutes or more, 30 minutes or more, or 45 minutes or more, and may be 180 minutes or less, 150 minutes or less, 120 minutes or less, or 90 minutes or less.

Each individual particle of the first alloy powder must have one main phase having a crystal structure represented by $(R^1,R^2,R^3)_2T_{14}B$, and $R^1$ is essential. The melt of the second ally (hereinafter, sometimes simply referred to as "melt") has a composition represented by $(R^4_pR^5_q)_{100-u}M^2_u$, and $R^5$ does not contain a light rare earth element, i.e., $R^1$. Although not bound by theory, this configuration suggests the followings.

At the interface between the main phase surface and the melt, $R^1$ and $R^5$ are mutually diffused. More specifically, $R^1$ is expelled from the main phase surface to the melt, and $R^5$ intrudes into the main phase from the melt. The main phase is then divided into a core part into which $R^5$ did not intrude and a shell part into which $R^5$ intruded. Compared with a light rare earth element like 10, an intermediate rare earth element and a heavy rare earth element (a rare earth element other than a light rare earth element), like $R^5$, can increase the anisotropic magnetic field of the main phase. Since the concentration of $R^5$ is higher in the shell part than in the core part, the anisotropic magnetic field is higher in the shell part than in the core part. For this reason, even when main phases (individual particles of the first alloy powder) after contact with the second alloy are aligned with each other, the core part is magnetically separated by the shell part. As a result, the coercive force is enhanced. Incidentally, the anisotropic magnetic field is a physical property value indicating the size of the coercive force of a permanent magnet.

Furthermore, $M^2$ of the melt of the second alloy can hardly intrude into the main phase (each individual particle of the first alloy powder), and therefore the reduction of magnetization can be suppressed. Accordingly, a production method of a rare earth magnet capable of enhancing the coercive force while preventing the deterioration of magnetization ca be provided.

The contact of each individual particle of the first alloy powder with the melt of the second alloy can be performed according to the following embodiment. That is, the embodiment includes cooling the melt of the second alloy to obtain a second alloy ingot, pulverizing the second alloy ingot to obtain a second alloy powder, mixing the first alloy powder and the second alloy powder to obtain a mixed powder, compressing the mixed powder to obtain a compact, and sintering the compact to obtain a sintered body, in which the first alloy powder is put into contact with the melt of the second alloy powder during sintering. This embodiment is described below step by step.

<Step of Cooling Melt of Second Alloy>

The melt of the second alloy is cooled to obtain a second alloy ingot. As to the second alloy ingot, the size of the crystal grain is not particularly limited, and therefore the cooling rate of the melt of the second alloy is not particularly limited.

The cooling method of the melt of the second alloy may comply with the cooling method of the melt of the first alloy. In the case of cooling the melt of the second alloy by a single roll method, the circumferential velocity may or may not comply with that of a single roll in the case of cooling the melt of the first alloy by a single roll method. In the case of not conforming, the circumferential velocity of a single roll in a liquid quenching method may be employed. When the circumferential velocity of a single roll in a liquid quenching method is employed, segregation in the second alloy ingot can be suppressed. Consequently, at the time of obtaining the second alloy powder by pulverizing the second alloy ingot, the composition of the second alloy powder becomes more uniform.

The circumferential velocity of the single roll in the liquid quenching method may be, for example, 20 m/s or more, 21 m/s or more, 22 m/s or more, or 23 m/s or more, and may be 50 m/s or less, 30 m/s or less, 29 m/s or less, 28 m/s or less, or 27 m/s or less.

<Step of Pulverizing Second Alloy Ingot>

The second alloy ingot is pulverized to obtain a second alloy powder. The second alloy powder is mixed with the first alloy powder. The particle diameter of the second alloy powder is not particularly limited as long as it does not affect the mixing. From the viewpoint of uniformly mixing the first alloy powder and the second alloy powder, the particle diameter of the second alloy powder may be, for example, 2 μm or more, 5 μm or more, or 10 μm or more, and may be 50 μm or less, 30 μm or less, or 20 μm or less.

The pulverization method is not particularly limited. The pulverization method includes, for example, a method of pulverizing the second alloy ingot by using a jet mill and/or a ball mill, etc. The air stream used in the jet mill includes, for example, a nitrogen stream.

Before pulverization using a jet mill and/or a ball mill, etc., the second alloy ingot may be roughly pulverized using, for example, a jaw crusher and/or a hammer mill.

Before pulverizing the second alloy ingot, hydrogen may be stored in the second alloy ingot. The method and effects thereof etc. of hydrogen storage are the same as those in the case of storing hydrogen in the first alloy ingot.

<Step of Mixing First Alloy Powder and Second Alloy Powder>

The first alloy powder and the second alloy powder are mixed to obtain a mixed powder. As long as the first alloy powder and the second alloy powder can be uniformly mixed, the mixing method is not particularly limited. The method includes, for example, a method of charging the first alloy powder and the second alloy powder into a mortar and mixing the powders.

The mixed powder may be obtained by mixing the first alloy powder and the second alloy powder while pulverizing the first alloy ingot and the second alloy ingot at the same time. By performing pulverization and mixing at the same time in this way, the first alloy powder and the second alloy powder can be more uniformly mixed.

The method for simultaneously performing pulverization and mixing includes, for example, a method of mixing the first alloy powder and the second alloy powder while pulverizing the first alloy ingot and the second alloy ingot at the same time by using a jet mill to obtain a mixed powder.

Mixing of the first alloy powder and the second alloy powder may be performed at not less than the room temperature and less than the melting point of the second alloy powder or may be performed at not less than the melting point of the second alloy powder and 800° C. or less. When the first alloy powder and the second alloy powder are mixed at not less than room temperature and less than the melting point of the second alloy powder, the first alloy powder and the second alloy powder are mixed just as they are. On the other hand, when the first alloy powder and the second alloy powder are mixed at not less than the melting point of the second alloy powder and 800° C. or less, the second alloy covers the surface of each individual particle of the first alloy powder. This covering facilitates contact of the first alloy powder with the melt of the second alloy powder at the time of sintering. Incidentally, in the present description, unless otherwise indicated, the room temperature means 25° C.

<Step of Compressing Mixed Powder>

The mixed powder is compacted to obtain a green compact. The compacting method may be a conventional method. The method includes, for example, a method of charging the powders in a mold and compressing the powders by using a press machine. The compacting may be performed at room temperature. The pressure at the time of compacting may be, for example, 30 MPa or more, 60 MPa or more, or 90 MPa, and may be 500 MPa or less, 300 MPa or less, or 150 MPa or less. The pressing time may be, for example, 5 minutes or more, 15 minutes or more, 30 minutes or more, or 45 minutes or more, and may be 180 minutes or less, 120 minutes or less, 100 minutes or less, or 80 minutes or less.

The green compact may also be obtained by compressing the mixed powder in a magnetic field. By this operation, individual particles of the first alloy powder in the green compact are oriented in the direction of the magnetic field. As a result, anisotropy can be imparted to a rare earth magnet obtained by the production method of the present disclosure.

The magnetic field applied includes, for example, a DC magnetic field and a pulsed magnetic field. The magnitude of the magnetic field applied may be, in the case of the DC magnetic field, 0.3 T or more, 0.5 T or more, or 1.0 T or more, and may be 5.0 T or less, 3.0 T or less, or 2.0 T or less. The magnitude of the magnetic field applied may be, in the case of the pulsed magnetic field, 1.0 T or more, 2.0 T or more, or 3.0 T or more, and may be 7.0 T or less, 6.0 T or less, or 5.0 T or less.

The direction of the magnetic field applied may be determined according to the direction in which the particles are intended to be oriented, and includes, for example, a compression direction and a direction perpendicular to the compression direction.

<Step of Sintering Green Compact>

The green compact is sintered to obtain a sintered body. For preventing oxidation of the green compact and evaporation of the rare earth element, sintering is preferably performed in a vacuum or an inert gas atmosphere. The inert gas atmosphere includes a nitrogen gas atmosphere. In the case of not sintering the green compact in a vacuum or an inert gas atmosphere, with respect to the compositions of the first alloy powder and/or the second alloy powder, the content of the rare earth element may be previously increased by taking into account the evaporation of the rare earth element.

As long as liquid-phase sintering can be performed at a temperature of not less than the melting point of the second alloy powder, the sintering may be either pressure sintering or pressureless sintering.

The sintering temperature may be appropriately selected in the range of not less than the melting point of the second alloy powder and not more than the melting point of the first alloy powder. By sintering the green compact at such a temperature, the first alloy powder is not melted inside of the green compact during sintering and the second alloy powder is melted. Consequently, the first alloy powder can be put into contact with the melt of the second alloy (second alloy powder). The effects due to the contact of the first alloy powder with the melt of the second alloy (second alloy powder) are as described above.

The sintering temperature may be, in the case of pressureless sintering, typically 950° C. or more, 1,000° C. or more, or 1,050° C. or more, and may be 1,200° C. or less, 1,150° C. or less, or 1,100° C. or less. The sintering temperature may be, in the case of pressure sintering, typically 600° C. or more, 800° C. or more, or 900° C. or more, and may be 1,200° C. or less, 1,150° C. or less, or 1,100° C. or less.

The sintering time may be appropriately determined according to the mass, etc. of the green compact. The sintering time may be, in the case of pressureless sintering, for example, 0.1 hours or more, 1.0 hours or more, 2.0 hours or more, 3.0 hours or more, or 4.0 hours or more, and may be 50.0 hours or less, 30.0 hours or less, 20.0 hours or less, 12.0 hours or less, 10.0 hours or less, 8.0 hours or less, 6.0 hours or less, or 5.0 hours or less. The sintering time may be, in the case of pressure sintering, for example, 0.01 hours or more, 0.05 hours or more, 0.10 hours or more, or 0.50 hours or more, and may be 20.00 hours or less, 10.00 hours or less, 5.00 hours or less, 2.00 hours or less, 1.50 hours or less, 1.00 hours or less, or 0.75 hours or less.

In this way, compared with pressureless sintering, in the pressure sintering, the green compact can be sintered at a relatively low temperature, and the sintering time is short. Consequently, in the case of pressureless sintering, a change in the composition of the second alloy powder can be suppressed, and the crystal grain of the sintered body can be prevented from coarsening.

The pressure sintering includes, for example, applying a hydrostatic pressure to the green compact. The hydrostatic pressure may be, typically, 40 MPa or more, 100 MPa or more, 200 MPa or more, 300 MPa or more, or 400 MPa or more, and may be 1,000 MPa or less, 900 MPa or less, 800 MPa or less, 700 MPa or less, or 600 MPa or less.

As described above, hydrogen stored in the first alloy ingot and/or the second alloy ingot may be removed during sintering. For this purpose, the green compact may be heated in a vacuum in the temperature rise process (300 to 500° C.) at the time of sintering.

<Step of Heat-Treating Sintered Body>

If desired, the sintered body may further be heat-treated. By this treatment, the shell part can be thickened.

The heat treatment temperature is preferably not less than the melting point of the second alloy powder and 1,000° C. or less. When the heat treatment temperature is not less than the melting point of the second alloy powder, the shell part can be thickened. On the other hand, when the heat treatment temperature is 1,000° C. or less, grain growth of the main phase having a core/shell structure can be suppressed.

The heat treatment time may be appropriately determined according to the mass, etc. of the sintered body. The heat treatment time may be, typically, 0.2 hours or more, 1.0 hours or more, 5.0 hours or more, 10.0 hours or more, or 15.0 hours or more, and may be 48.0 hours or less, 40.0 hours or less, 36.0 hours or less, 24 hours or less, or 20.0 hours or less.

In the case where the second alloy is a Cu-based eutectic alloy, since the melting point of the alloy is low, the heat treatment temperature may be, for example, 500° C. or more, 550° C. or more, or 600° C. or more, and may be 800° C. or less, 750° C. or less, or 700° C. or less. In the case where the second alloy is a Cu-based eutectic alloy, the heat treatment time may be, for example, 1.0 hours or more, 3.0 hours or more, or 5.0 hours or more, and may be 12.0 hours or less, 9.0 hours or less, or 7.0 hours or less.

For preventing oxidation of the sintered body and evaporation of the rare earth element, the heat treatment is preferably performed in a vacuum or an inert gas atmosphere. The inert gas atmosphere includes a nitrogen gas atmosphere.

<Step of Diffusing and Infiltrating Third Alloy into Sintered Body>

A third alloy may be further diffused and infiltrated into the sintered body. The method of diffusing and infiltrating includes, for example, a method of putting a third alloy ingot into contact with the sintered body and heat-treating the ingot at not less than the melting point of the third alloy. It may also be possible to charge the sintered body into a third alloy powder and heat-treat the ingot at not less than the melting point of the third alloy. By diffusing and infiltrating the third alloy in this way, the third alloy is diffused and infiltrated into the boundary phase in the sintered body and stronger magnetic separation of main phases from each other in the sintered body can be achieved, contributing to more enhancement of the coercive force.

The composition of the third alloy is represented by $(R^4_pR^5_q)_{100-u}M^2_u$ (wherein $R^4$ is one or more members selected from the group consisting of Sc, Ce, La, and Y, $R^5$ is one or more members selected from the group consisting of Nd, Pr, Sm, Eu, Gd, Tb, Dy, Ho, Er, Tm, Yb, and Lu, $M^2$ represents one or more alloy elements for decreasing the melting point of $(R^4_pR^5_q)_{100-u}M^2_u$ to be lower than the melting points of $R^4$ and $R^5$ by alloying $R^4$ and $R^5$ with $M^2$, and an unavoidable element, and $0 \le p \le 0.2$, $0.8 \le q \le 1.0$, $p+q=1.0$, and $10 \le u \le 50$). Requirements for the composition of the third alloy may comply with the requirements for the composition of the second alloy. In addition, the temperature at the time of diffusing and infiltrating the third alloy into the sintered body may be appropriately selected in the range of not less than the melting point of the third alloy and not more than the melting point of the first alloy. Typically, the temperature may comply with the temperature during pressure sintering of the green compact. The diffusing and infiltrating time may also comply with the time during pressureless sintering of the green compact.

EXAMPLES

The production method of a rare earth magnet of the present disclosure is more specifically described below by referring to Examples. Incidentally, the production method of the rare earth magnet of the present disclosure is not limited to the conditions employed in the following Examples.

<Preparation of Sample>

Each sample was prepared in the following manner.

Example 1

A melt of a first alloy having a composition represented by $Ce_{14.33}Fe_{79.24}Cu_{0.10}B_{5.74}Ga_{0.40}Al_{0.19}$ was prepared. This melt was cast into a book mold at 1,380° C. to obtain a first alloy ingot. At this time, the cooling rate was 10 K/sec in the thickness center of the book mold. The thickness of the first alloy ingot was 5 mm.

The first alloy ingot was roughly pulverized to a particle diameter of 100 μm by using a cutter mill. The roughly pulverized pieces were exposed to a hydrogen atmosphere at 150° C. to store hydrogen in the roughly pulverized piece. The amount of hydrogen stored was 0.1 MPa in terms of hydrogen pressure. The roughly pulverized piece storing hydrogen was pulverized to 32 μm by using a cutter mill to obtain finely pulverized pieces. Furthermore, the finely pulverized piece was pulverized to 10 μm by using a jet mill to obtain a first alloy powder. Incidentally, the particle diameter is an average equivalent-circle diameter of projected areas of all particles.

The first alloy powder and a second alloy ingot having a composition represented by $Nd_{70}Cu_{30}$ were charged into a vacuum heat-treatment furnace at 700° C. for 60 minutes, thereby putting the first alloy powder into contact with a melt of a second alloy powder, and the powder was then cooled and used as the sample of Example 1.

Comparative Example 1

The first alloy powder as was pulverized by a jet mill, obtained at the time of preparing the sample of Example 1, was subjected to dehydrogenation heat treatment and used as the sample of Comparative Example 1. The dehydrogenation heat treatment was performed at 400° C. for 1 hour.

Example 2

A melt of a first alloy having a composition represented by $Ce_{14.33}Fe_{79.24}Cu_{0.10}B_{5.74}Ga_{0.40}Al_{0.19}$ was prepared. This melt was cast into a book mold at 1,380° C. to obtain a first alloy ingot. At this time, the cooling rate was 10 K/sec in the thickness center of the book mold. The thickness of the first alloy ingot was 5 mm.

The first alloy ingot was roughly pulverized to a particle diameter of 100 μm by using a cutter mill. The roughly pulverized pieces were exposed to a hydrogen atmosphere at 150° C. to store hydrogen in the roughly pulverized piece. The amount of hydrogen stored was 0.1 MPa in terms of hydrogen pressure. The roughly pulverized piece storing hydrogen was pulverized to 32 μm by using a cutter mill to obtain finely pulverized pieces. Furthermore, the finely pulverized piece was pulverized to 10 μm by using a jet mill to obtain a first alloy powder. Incidentally, the particle diameter is an average equivalent-circle diameter of projected areas of all particles.

A second alloy ingot having a composition represented by $Nd_{70}Cu_{30}$ was pulverized by using a cutter mill until the size of the alloy powder became 10 μm, and a second alloy powder was thereby obtained. Incidentally, the size of the alloy powder is an average equivalent-circle diameter of projected areas of all particles.

100 mass % of the first alloy powder and 10 mass % of the second alloy powder were charged into a mortar and mixed to obtain a mixed powder.

The mixed powder was compression-molded in a DC magnetic field of 1 T to obtain a green compact. The compacting was performed at room temperature. The pressure at the time of compacting was 100 MPa.

The green compact was sintered at 700° C. over 18 hours in an argon atmosphere to obtain a sintered body. The sintering pressure was 200 MPa. This sintered body was used as the sample of Example 2.

Example 3

A second alloy was further diffused and infiltrated into the sintered body obtained at the time of preparing of the sample of Example 2. The diffusion and infiltration was carried out by performing a heat treatment at 700° C. for 360 minutes in an argon atmosphere in the state of the sintered body being put into contact with the second alloy ingot. The amount of the second alloy diffused and infiltrated was 10 mass % of second alloy ingot relative to the sintered body. The thus-obtained sintered body after diffusing and infiltrating was used as the sample of Example 3.

Example 4

The sample of Example 4 was prepared in the same manner as in Example 1 other than that a melt of a first alloy having a composition represented by $Ce_{7.75}La_{3.26}Nd_{2.03}Pr_{0.83}Fe_{75.64}Co_{4.46}B_{5.66}Ga_{0.37}$ was prepared.

Comparative Example 2

The sample of Comparative Example 2 was prepared in the same manner as in Comparative Example 1 other than that a melt of a first alloy having a composition represented by $Ce_{7.75}La_{3.26}Nd_{2.03}Pr_{0.83}Fe_{75.64}Co_{4.46}B_{5.66}Ga_{0.37}$ was prepared.

Evaluation

Each sample was measured for the coercive force and the magnetization. The measurement was performed at room temperature by using a Vibrating Sample Magnetometer (VSM) manufactured by Lake Shore. With respect to Comparative Examples 1 and 2, the measurement was performed using a sample obtained by resin-embedding the powder after dehydrogenation heat treatment.

With respect to the sample of Examples 1 and 2, a composition analysis (EDX analysis) was performed by observing the microstructure by using a scanning transmission electron microscope (STEM).

Figure 2:
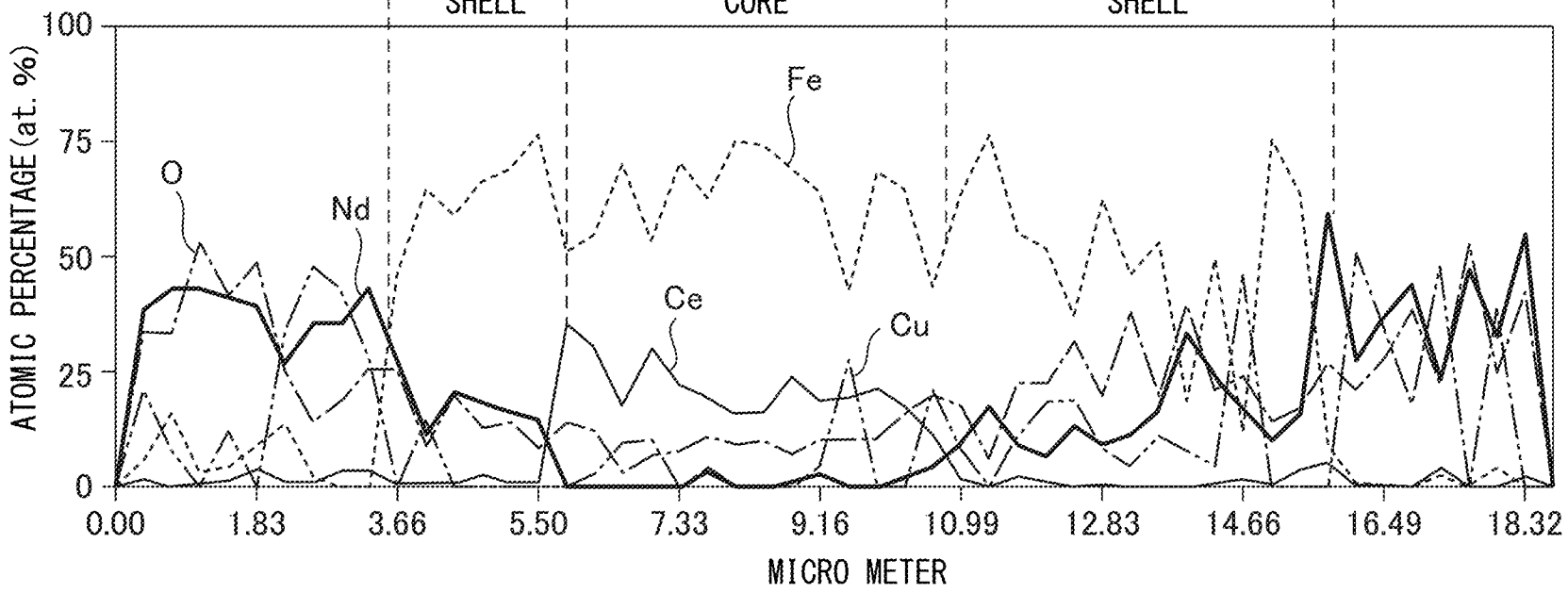
FIG. 2 is a diagram illustrating the portions analyzed by EDX along the white dashed arrow of FIG. 1.
Figure 3:
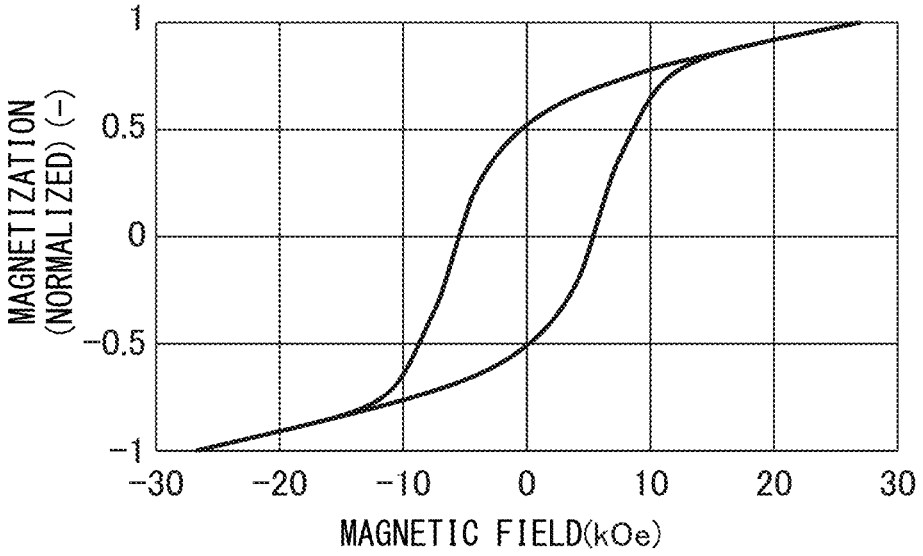
FIG. 3 is a graph illustrating a magnetization curve of the sample of Example 1.
Figure 4:
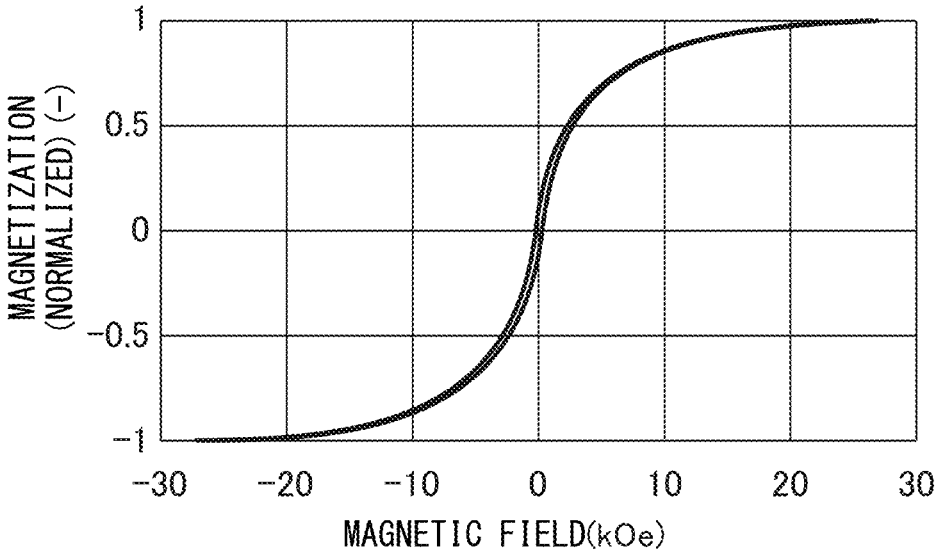
FIG. 4 is a graph illustrating a magnetization curve of the sample of Comparative Example 1.
Figure 5:
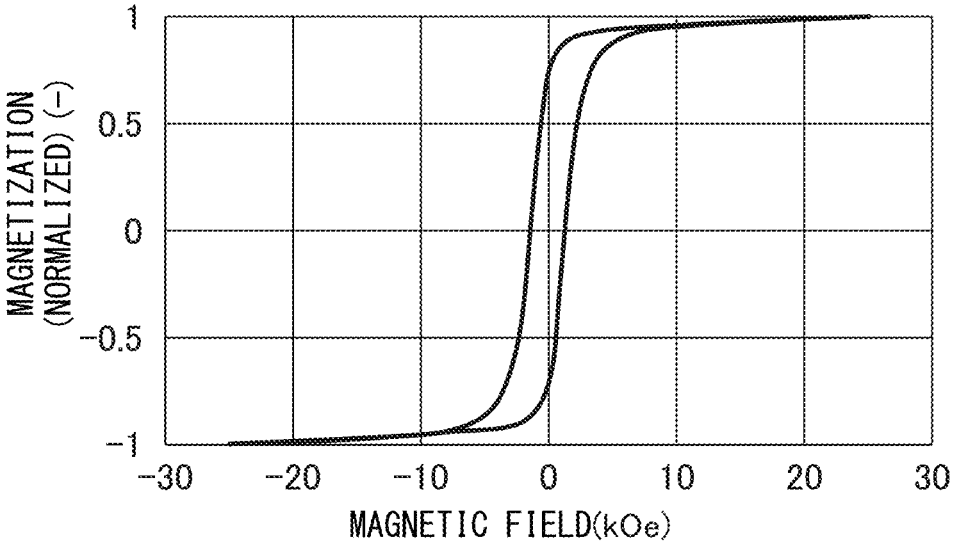
FIG. 5 is a graph illustrating a magnetization curve of the sample of Example 2.
Figure 6:
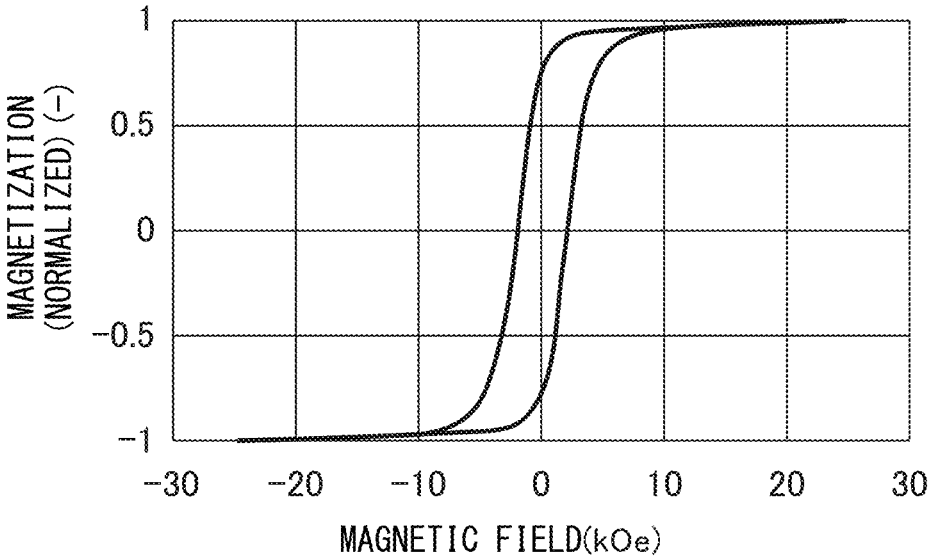
FIG. 6 is a graph illustrating a magnetization curve of the sample of Example 3.
Figure 7:
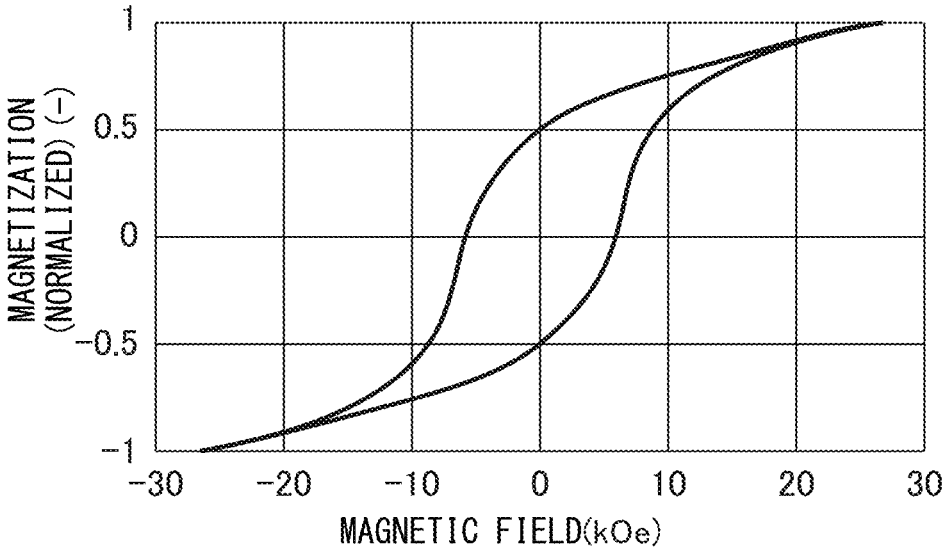
FIG. 7 is a graph illustrating a magnetization curve of the sample of Example 4.
Figure 8:
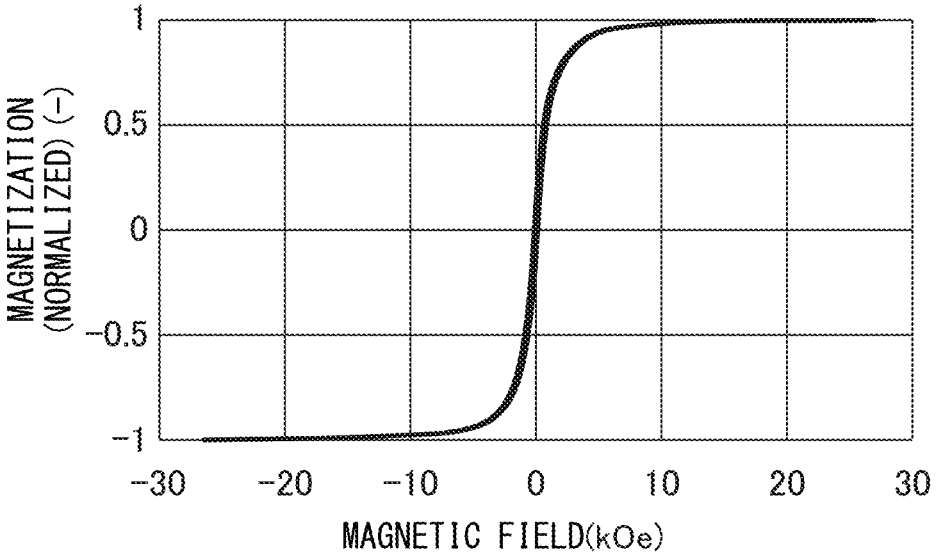
FIG. 8 is a graph illustrating a magnetization curve of the sample of Comparative Example 2.
Figure 9:
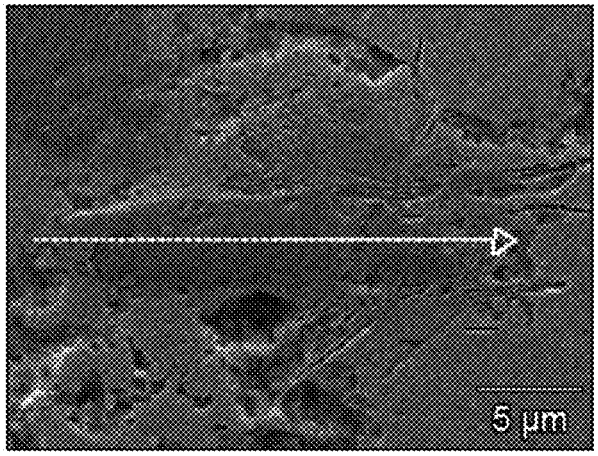
FIG. 9 is a diagram illustrating a scanning transmission electron microscope image of the sample of Example 2.
Figure 10:
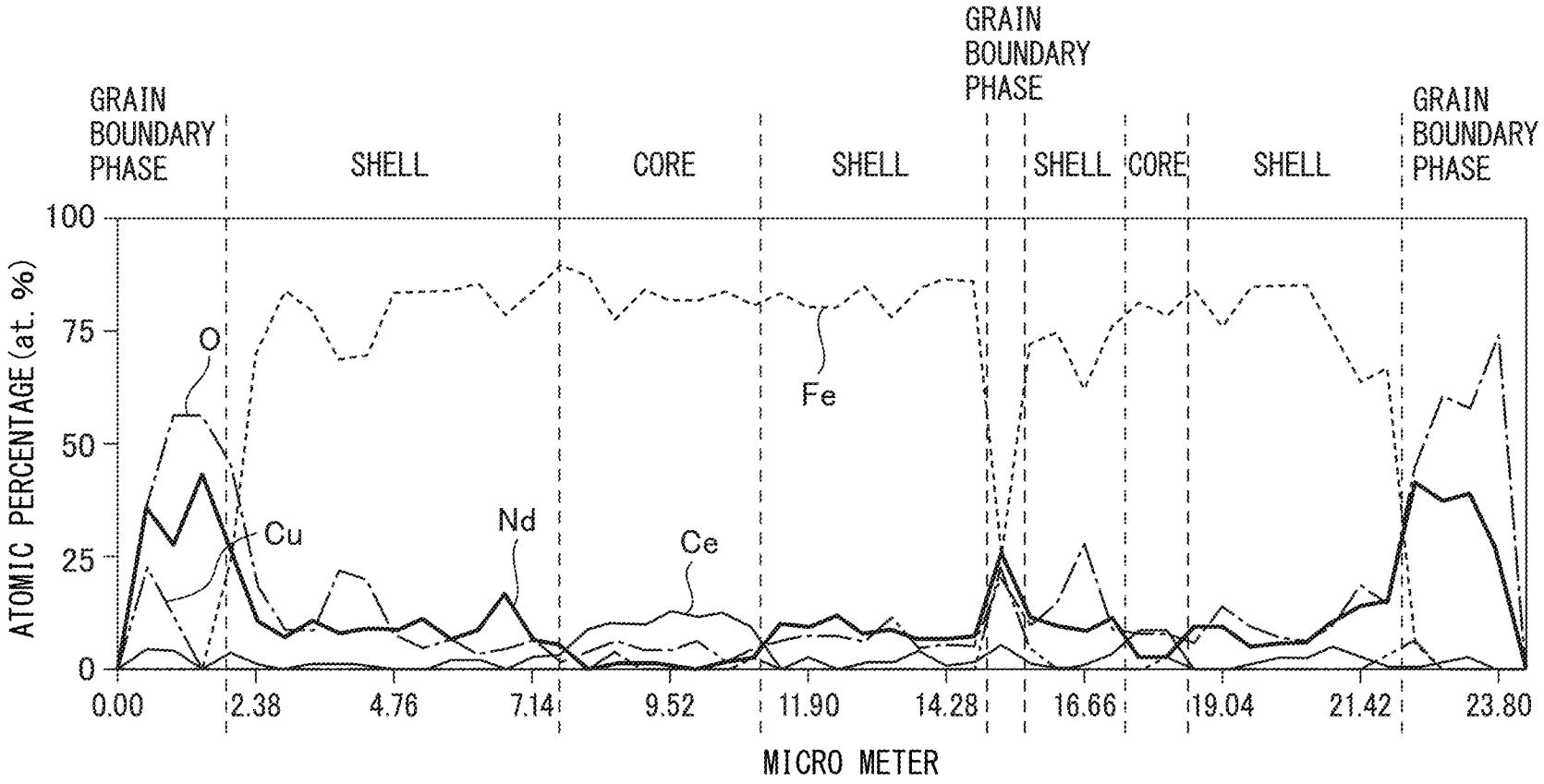
FIG. 10 is a diagram illustrating the portions analyzed by EDX along the white dashed arrow of FIG. 9.

FIGS. 1 to 10 show the evaluation results. FIG. 1 is a diagram illustrating a scanning transmission electron microscope (STEM) image of the sample of Example 1. FIG. 2 is a diagram illustrating the portions analyzed by EDX along the white dashed arrow of FIG. 1. FIG. 3 is a graph illustrating a magnetization curve of the sample of Example 1. FIG. 4 is a graph illustrating a magnetization curve of the sample of Comparative Example 1. Incidentally, as for the magnetization in FIGS. 3 and 4, a numerical value is normalized relative to the magnetization at the time of application of a maximum external magnetic field (27 kOe on the x-axis of FIGS. 3 and 4) of the vibrating sample magnetometer used. FIG. 5 is a graph illustrating a magnetization curve of the sample of Example 2. FIG. 6 is a graph illustrating a magnetization curve of the sample of Example 3. FIG. 7 is a graph illustrating a magnetization curve of the sample of Example 4. FIG. 8 is a graph illustrating a magnetization curve of the sample of Comparative Example 2. FIG. 9 is a diagram illustrating a scanning transmission electron microscope (STEM) image of the sample of Example 2. FIG. 10 is a diagram illustrating the portions analyzed by EDX along the white dashed arrow of FIG. 9.

In FIG. 2, the portion indicated as shell part-core part-shell part is the particle of a first alloy powder (hereinafter, sometimes referred to as "first alloy particle"). Both sides of the first alloy particle is a portion in which the melt of the second alloy ingot (hereinafter, sometimes referred to as "second alloy melt") is solidified.

As seen from FIG. 2, compared with the core part, the Ce concentration in the shell part is very low. In addition, while the Nd concentration in the core part is substantially 0 at %, the Nd concentration is increased from the inner side (core part side) toward the outer side (opposite side of the core part) of the shell part. From these results, it is believed that when the first alloy particle is put into contact with the second alloy melt, Ce is expelled from the first alloy particle to the second alloy melt and Nd intrudes into the first alloy particle from the second alloy melt.

As seen from FIG. 3, the coercive force of Example 1 is 5.5 kOe. On the other hand, as seen from FIG. 4, the coercive force of Comparative Example 1 is substantially 0 kOe. The magnetization is substantially the same between Example 1 and Comparative Example 1. From these results, it could be confirmed that the coercive force can be enhanced while suppressing the reduction of magnetization.

As seen from FIG. 5, the coercive force of Example 2 is 1.37 kOe. As seen from FIG. 6, the coercive force of Example 3 is 2.10 kOe. From these result, it could be confirmed that even when the green compact of the mixed powder is sintered to obtain a sintered body, the coercive force is exhibited. Furthermore, compared with the sample of Example 2, the coercive force of the sample of Example 3 is high, and therefore it could be confirmed that when the second alloy is diffused and infiltrated into the sintered body, the coercive force can be more enhanced.

As seen from FIG. 8, the coercive force of Example 4 is 5.84 kOe. On the other hand, as seen from FIG. 9, the coercive force of Comparative Example 2 is 0.18 kOe. The magnetization is substantially the same between Example 4 and Comparative Example 2. From these results, it could be confirmed that even when Ce and La are present together as $R^1$ and at the same time, $R^2$ is contained, similarly to the sample of Example 1, the coercive force in the sample of Example 4 can be enhanced while suppressing the reduction magnetization.

As seen from FIG. 10, compared with the core part, the Ce concentration in the shell part is very low. In addition, while the Nd concentration in the core part is substantially 0 at %, the Nd concentration is increased from the inner side (core part side) toward the outer side (opposite side of the core part, i.e., grain boundary phase side) of the shell part. From these results, it is believed that even when the first alloy particle is put into contact with the second alloy melt during sintering, Ce is expelled from the first alloy particle to the second alloy melt and Nd intrudes into the first alloy particle from the second alloy melt. It could be confirmed that the main phase (magnetic phase) derived from the first alloy consequently has a core-shell structure.

From these results, the effects of the production method of a rare earth magnet of the present invention could be verified.

The invention claimed is:

1. A method for producing a rare earth magnet, comprising:

preparing a melt of a first alloy having a composition represented by $(R^1_vR^2_wR^3_x)_yT_zB_sM^1_t$ (wherein R is one or more members selected from the group consisting of Sc, Ce, La, and Y, $R^2$ is one or more members selected from the group consisting of Nd, Pr, Sm, Eu, and Gd, $R^3$ is one or more members selected from the group consisting of Tb, Dy, Ho, Er, Tm, Yb, and Lu, T is one or more members selected from the group consisting of Fe, Ni, and Co, B is boron, $M^1$ represents one or more members selected from the group consisting of Ti, Ga, Zn, Si, Al, Nb, Zr, Mn, V, W, Ta, Ge, Cu, Cr, Hf, Mo, P, C, Mg, Hg, Ag, Au, O, and N, and an unavoidable impurity element, and $0.1 \le v \le 1.0$, $0 \le w \le 0.9$, $0 \le x \le 0.5$, $v+w+x=1.0$, $12 \le y \le 20$, $5 \le s \le 20$, $0 \le t \le 3$, and $z=100-y-s-t$), cooling the melt of the first alloy at a rate of from $10^0$ to 102 K/sec to obtain a first alloy ingot having a plurality of main phases and a $(R^1,R^2,R^3)$-rich grain boundary phase present therearound, and wherein the particle diameter of the main phase is 1 to 20 μm, pulverizing the first alloy ingot to obtain a first alloy powder having a particle diameter of 1 to 20 m such that the grain boundary phase is removed and one main phase is formed as one particle, preparing a melt of a second alloy having a composition represented by $(R^4_pR^5_q)_{100-u}M^2_u$ (wherein $R^4$ is one or more members selected from the group consisting of Sc, Ce, La, and Y, $R^5$ is one or more members selected from the group consisting of Nd, Pr, Sm, Eu, Gd, Tb, Dy, Ho, Er, Tm, Yb, and Lu, $M^2$ are unavoidable elements and one or more members selected from the group consisting of Cu, Al, and Co, and $0 \le p \le 0.2$ $0.8 \le q \le 1.0$, $p+q=1.0$, and $10 \le u \le 50$), and putting the main phase of the first alloy powder particle into direct contact with the melt of the second alloy without intervention of the grain boundary phase to obtain the main phase having a core/shell structure.

2. The method according to claim 1, wherein v is $0.3 \le v \le 1.0$.

3. The method according to claim 1, wherein v is $0.5 \le v \le 1.0$.

4. The method according to claim 1, further comprising storing hydrogen in the first alloy ingot.

5. The method according to claim 1, comprising:

cooling the melt of the second alloy to obtain a second alloy ingot, pulverizing the second alloy ingot to obtain a second alloy powder, mixing the first alloy powder and the second alloy powder to obtain a mixed powder, compressing the mixed powder to obtain a green compact, and sintering the compact to obtain a sintered body, wherein the first alloy powder is put into contact with a melt of the second alloy powder during the sintering.

6. The method according to claim 5, compressing the mixed powder in a magnetic field to obtain the green compact.

7. The method according to claim 5, mixing the first alloy ingot and the second alloy ingot while pulverizing the ingots at the same time to obtain the mixed powder.

8. The method according to claim 5, further comprising storing hydrogen in the second alloy ingot.

9. The method according to claim 5, mixing the first alloy powder and the second alloy powder at a temperature of room temperature or more and less than the melting point of the second alloy powder.

10. The method according to claim 5, mixing the first alloy powder and the second alloy powder at a temperature of the melting point of the second alloy powder or more and 800° C. or less.

11. The method according to claim 5, further comprising heat-treating the sintered body at the temperature of the melting point of the second alloy powder or more and 1,000° C. or less.

12. The method according to claim 5, further comprising diffusing and infiltrating a third alloy into the sintered body, wherein the third alloy has a composition represented by $(R^4{}_pR^5{}_q)_{100-u}M^2{}_u$(wherein $R^4$ is one or more members selected from the group consisting of Sc, Ce, La, and Y, $R^5$ is one or more members selected from the group consisting of Nd, Pr, Sm, Eu, Gd, Tb, Dy, Ho, Er, Tm, Yb, and Lu, $M^2$ are unavoidable elements and one or more members selected from the group consisting of Cu, Al, and Co, $0 \le p \le 0.2$, $0.8 \le q \le 1.0$, $p+q=1.0$, and $10 \le u \le 50$).

13. The method according to claim 1, wherein $0.7 \le v \le 1.0$, $0 \le w \le 0.1$ and $0 \le x \le 0.1$.

14. The method according to claim 1, wherein $0 \le p \le 0.05$ and $0.95 \le q \le 1.0$.

* * * * *